US005486811A

United States Patent [19]

Wehrle et al.

[11] Patent Number: 5,486,811

[45] Date of Patent: Jan. 23, 1996

[54] FIRE DETECTION AND EXTINGUISHMENT SYSTEM

[75] Inventors: John P. Wehrle, Greenbelt, Md.; Ernest A. Dahl, Ventura, Calif.; James R. Lugar, Annapolis, Md.

[73] Assignee: The United States of America as represented by the Secretary of the Navy, Washington, D.C.

[21] Appl. No.: 193,984

[22] Filed: Feb. 9, 1994

[51] Int. Cl.[6] ..... G08B 19/00

[52] U.S. Cl. ..... 340/522; 340/521; 340/511; 340/517; 340/628; 340/578; 169/23; 169/60

[58] Field of Search ..... 340/511, 517, 340/521, 518, 628, 578, 629, 522, 825.06; 169/60, 61, 23

[56] References Cited

U.S. PATENT DOCUMENTS

| | | | |
|---|---|---|---|
| 4,005,754 | 2/1977 | Linden et al. | 340/517 |
| 4,148,022 | 4/1979 | Hetznecker | 340/628 |
| 4,319,229 | 3/1982 | Kirkor | 340/517 |
| 4,749,986 | 6/1988 | Otani et al. | 340/511 |
| 4,785,292 | 11/1988 | Kern et al. | 340/578 |
| 4,796,205 | 1/1989 | Ishii et al. | 340/518 |
| 5,260,687 | 11/1993 | Yamauchi et al. | 340/521 |
| 5,281,951 | 1/1994 | Okayama | 340/511 |

*Primary Examiner*—Donnie L. Crosland
*Attorney, Agent, or Firm*—Gary G. Borda

[57] ABSTRACT

Early fire detection and extinguishment is provided by a plurality of fire detection units, each associated with a localized portion of a protected space and including condition sensors specifically appropriate to the environment of that localized portion of a protected space by a selected combination of condition sensors. A fire alarm annunciator and at least one controlled fire extinguishment system portion, or a stand-alone fire extinguishment system, is provided for each fire detection unit. A central control unit preferably includes a profile detector which evaluates outputs of one or more condition sensors over time to reduce false alarm rates while increasing sensitivity to early stage fires.

9 Claims, 3 Drawing Sheets

FIRE DETECTION AND EXTINGUISHMENT SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to fire detection and extinguishment systems for detecting and extinguishing fires in a protected space and, more particularly, to arrangements for improving sensitivity of fire detection and enhancing performance of fire extinguishment.

2. Description of the Related Art

Arrangements for detection of fires have been commercially available for many years. In particular, so-called smoke detectors using either ionization detectors to detect combustion products or photocell-type detectors to detect decrease in light intensity caused by opaque smoke particles have been effective and successful in providing early warning of fires in dwelling and other enclosed spaces.

However, these types of devices generally involve a fixed threshold or a weighted combination of detector output values in order to determine the existence of a fire. Often the threshold values are set high or the sensitivity is reduced in order to reduce the incidence of false alarms. Therefore, the installation location is often critical for proper performance of these devices. Specifically, installation is required to be in a location where smoke or combustion products are likely to accumulate, such as at horizontal ceilings enclosed by walls. In contrast, installations on walls or sloped surfaces often does not allow for accumulation of combustion products sufficient to actuate the alarm. Similarly, even when correctly located, air circulation currents (e.g. from an open window) may prevent proper operation of such sensors. In any event, the requirement of accumulation of combustion product slows the speed of detection since the fire must progress sufficiently to provide high levels of combustion products at the location of the sensor.

Known detectors also require significant amounts of maintenance in order to remain effective. For example, fouling of photocell detectors with dust, aerosols, moisture and the like can cause a decrease in measured level of light intensity and thus increased susceptibility to false alarms. On the other hand, fouling of ionization type detectors may reduce their sensitivity and prevent or delay detection of a fire.

Shipboard fires are particularly dangerous since escape from such fires is often limited by the architecture of the vessel. Additionally, auxiliary craft, such as life rafts and boats, which may be used to escape a fire, can expose personnel to other perils. Moreover, extinguishment of shipboard fires is complicated by the fact that the use of large quantities of water or other liquids may adversely affect the seaworthiness of the ship and may damage essential equipment. Therefore, it is important that shipboard fires be detected quickly to facilitate early extinguishment.

While residential type smoke alarms have been occasionally used in watercraft, they are generally less reliable than in fixed structures because of increased air circulation in moving vessels. Additionally, high temperatures and high humidity reduce the effectiveness of all types of fire sensors. Consequently, fire detection is complicated when enclosed areas of a vessel are subject to high humidity and periodic high levels of aerosols, such as from the galley and machinery, and to the high temperatures that are often encountered in mechanical areas of vessels such as engine rooms and auxiliary machinery spaces. Further, since most currently available detectors effectively require substantial progress of a fire before detection can occur, there is an increased likelihood of significant damage to the vessel before the fire can be extinguished. Any such damage to the vessel potentially increases risks to persons aboard the vessel.

The effectiveness of other types of detectors is also often impaired by shipboard conditions. For example, sensors which respond to rates of change of temperature often produce false alarms since vessels typically have many sources of heat which can cause localized temperature changes. By the same token, the illumination of enclosed spaces, typically by incandescent bulbs, can often cause infrared detectors to respond even though no fire is present. Sunlight reflected from water surfaces can also cause light-sensitive fire detectors to respond.

False alarm prevention is of particular concern aboard ships in connection with automatic fire extinguishment systems. Many fire extinguishment systems are charged with a fire extinguishing material and pressurized in order to function rapidly upon detection of a fire. Charging and pressurization of such systems often requires specialized equipment which may not be available aboard ship. A false alarm and actuation of such fire extinguishing systems may therefore leave a vessel vulnerable to a fire until the system can again be charged and pressurized. Further, to assure repeatable operability of such systems, operations such as draining or purging of the distribution system for the fire extinguishing fluids must be done after each actuation. Moreover, the actuation of such fire extinguishing systems may damage the vessel or its contents or reduce seaworthiness through contact with the fire extinguishing materials.

In summary, the trade-off between sensitivity of sensors and false alarms has kept the effectiveness of fire detection at a relatively low level, particularly for shipboard applications. This allows for unacceptable growth of potential fires prior to activation of automatic fire extinguishing equipment. Thus, there is a need for a system that provides early detection of shipboard fires, low probability of false alarms, and extinguishment of detected fires with minimal damage to the vessel or its contents.

SUMMARY OF THE INVENTION

It is therefore an object of the present invention to provide a fire detection and extinguishment system which will detect potential fires at extremely early stages thereof.

It is another object of the present invention to provide a detection system for potential fires which will provide for detection at earlier stages without increase of false alarms.

It is a further object of the invention to provide an automatic fire extinguishment system which is of increased effectiveness, particularly for potential fires in early stages of development.

It is yet another object of the present invention to provide a combination of early detection of potential fires and extinguishment thereof which will minimize damage to a structure by either the fire or the extinguishing medium.

In order to accomplish these and other objects the present invention provides a system to detect fires in the very early stages of formation, typically before smoke or flames are created, i.e., "smoldering" types of fires. The present invention further activates individual fine water mist extinguishment systems to remove the heat from "smoldering" fires before flaming combustion occurs.

Early fire detection and extinguishment is provided by a plurality of fire detection units, each associated with a localized portion of a protected space and including condition sensors specifically appropriate to the environment of that localized portion of a protected space by a selected combination of condition sensors. A fire alarm annunciator and at least one controlled fire extinguishment system element, or a stand-alone fire extinguishment system, is provided for each fire detection unit. A central control unit includes a profile detector which evaluates outputs of one or more condition sensors over time to reduce false alarm rates while increasing sensitivity to early stage fires.

Accordingly, the present invention provides a fire detection and extinguishment system for detecting and extinguishing fires in a protected space including at least one fire detector unit having at least a carbon monoxide sensor and a radiation sensitive flame detector wherein each fire detector unit is associated with a localized portion of the protected space, a central control unit having at least a profile detector responsive to data measured over a period of time by the carbon monoxide sensor and the radiation sensitive flame detector, a communication system for communicating between the fire detector units and the central control unit, and a controlled fire extinguishment system responsive to the central control unit. The fire detector units may also include other additional condition sensors such as temperature and humidity sensors or sensors sensitive to combustion products produced by specified materials within the protected space. The central control unit may additionally include a sampler for periodically sampling data measured by the fire detector unit and a memory for storing data. The central control unit has stored therein known data related to conditions indicative of early growth stages of a fire and corresponding to conditions measured by the sensors of the fire detector units. Upon the central control unit identifying a match between data measured by a particular fire detector unit and known data stored within the central control unit, the central control unit activates the controlled fire extinguishment system to extinguish the fire or potential fire detected in the localized portion of the protected space corresponding to the particular fire detector unit.

In accordance with another aspect of the invention, a fire detection unit including at least one condition sensor for sensing conditions related to early growth stages of a fire, a smoke detector, a housing suitable for having at least one condition sensor mounted therein and for having the smoke detector attached thereto, means for transmitting signals to a central location, means for connecting an output of at least one condition sensor to the means for transmitting signals to a central location, and means for connecting an output of the smoke detector to the means for transmitting signals to a central location.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
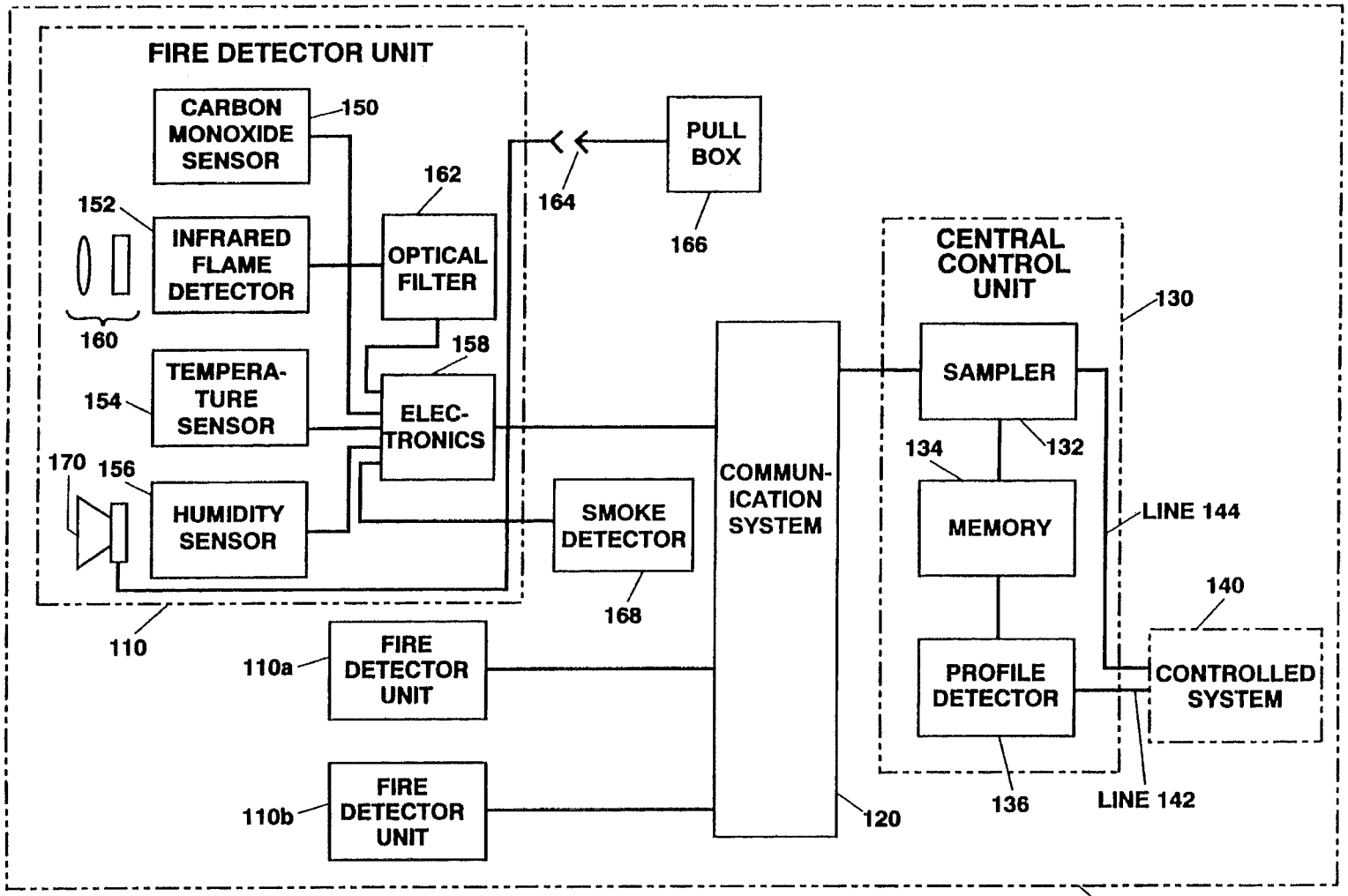
FIG. 1 is a schematic diagram of the overall system in accordance with the invention.

Referring now to the drawings, and more particularly to FIG. 1, there is shown, in schematic form, the overall fire detection and extinguishment system in accordance with the invention. Fire detection and extinguishment system 100 includes a plurality of fire detector units 110, 110*a*, 110*b*, etc., each capable of communicating, through a communication system 120, with a central control unit 130 and at least one controlled fire extinguishment system 140 having a plurality of localized water mist supply and distribution systems 310 (more fully described hereinafter in connection with FIG. 3) each corresponding to a particular fire detector unit. Central control unit 130 and controlled fire extinguishment system 140 communicate through control lines 142 and status lines 144.

The details of communication system 120 are not critical to the invention but it is considered preferable that central control unit 130 communicate with fire detector units 110 and controlled fire extinguishment systems 140 by polling, i.e., periodic sampling of selected data, since synchronization of the entire system is not required. However, the communication system could be of any form and could be synchronized throughout the system using multiplexers (MUX) and demultiplexers (DEMUX). Similarly, if desired, each fire detecting unit could have a separate communication link to the central control unit 130 by hard wiring, radiant energy, radio, ultrasound or any other medium of communication.

Central control unit 130 preferably contains sampler 132 to periodically receive measured data from fire detector 110, memory 134 to store sampled data from each fire detector unit 110, and profile detector 136 to compare measured data with stored profiles. In accordance with the overall concept of the invention, fire detection is accomplished with enhanced sensitivity and selectivity by comparing fire detector unit data collected over a period of time to stored data containing profiles of changes in one or more conditions and/or combinations of conditions which are known to be characteristic of early stages of a fire. Stored profile data can be stored in memory 134 or, alternatively, in profile detector 136. When profile detector 136 detects a match between collected data and stored profiles, a controlled fire extinguishment system 140 is activated for producing a central alarm and/or activating fire extinguishment apparatus of controlled fire extinguishment system 140. Controlled fire extinguishment system 140 may include a plurality of localized water mist supply and distribution systems 310 each corresponding to one or more particular fire detector units 110.

By thus providing selectivity in the detection of conditions which are characteristic of very early stages of potential fires (e.g., smoldering type fires even before smoke and/or flaming combustion occur), the sensitivity of condition detection or measurement need not be reduced in order to avoid false alarms. By combining in the present invention a highly selective fire detection system with a fire extinguishment system particularly effective for the extinguishment of potential fires in very early stages thereof (e.g., smoldering type fires) and that minimizes collateral damage during the operation thereof, the false alarm rate is minimized and a far higher degree of overall fire protection is provided with minimal damage from fire or the extinguishment thereof.

The electronics necessary for data sampling, data storage, retrieval of data in groups of predetermined size, and comparison of data with stored profiles is relatively small and inexpensive, particularly if special purpose integrated circuits are employed. In such a case, it would be possible to include sampler 132, memory 134 and profile detector 136 within each of fire detector units 110. Fire detector units 110 would then communicate directly with a corresponding controlled fire extinguishment system 140. In such a case, each particular fire detector unit 110 would communicate with a valve or valves to activate the localized water mist supply and distribution system 310 corresponding to the location of that particular fire detector unit 110. Alternatively, controlled fire extinguishment system 140 may comprise a separate, stand-alone fire extinguishment system provided for each fire detector unit 110. Although sampler 132, memory 134 and profile detector 136 may be included within each individual fire detector units 110, a central unit 130 is preferred since the same can then also be employed to monitor the condition of the fire detecting units and status of activation valves.

Figure 2:
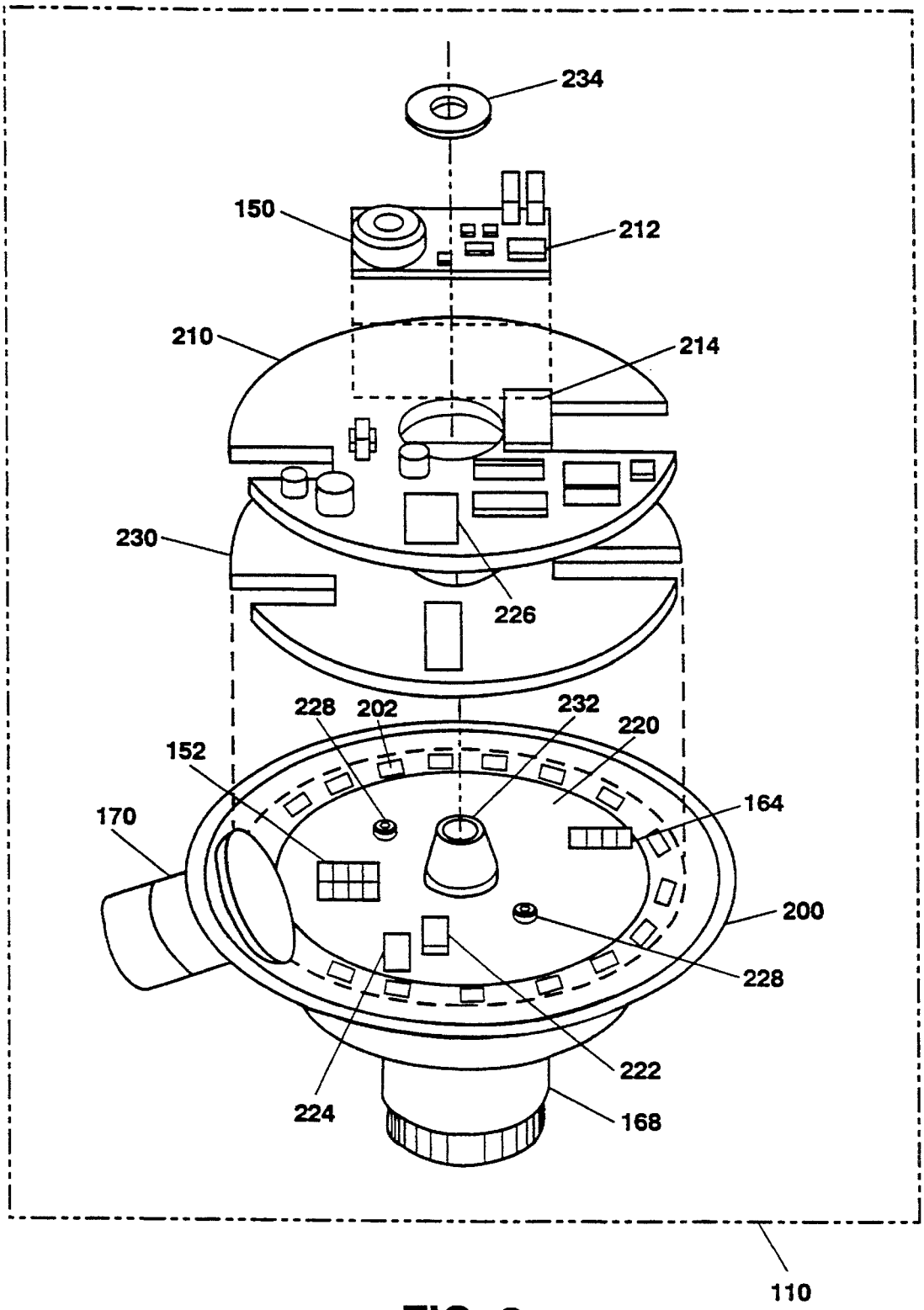
FIG. 2 is an exploded isometric view of a preferred construction of a fire detecting unit in accordance with the invention.

Referring to FIGS. 1 and 2, in accordance with a preferred embodiment of the invention, each fire detector unit 110 includes carbon monoxide sensor 150, a radiation sensitive flame detector such as infrared sensor 152, temperature sensor 154 and humidity sensor 156. Depending on the combustible materials present in a particular location of fire detector unit 110, additional sensors sensitive to particular combustion products can also be used. Many such types of sensors are known and commercially available. In any case, it is not necessary to provide sensors for combustion products which could not occur in a particular location. As schematically depicted by box 158, fire detector units 110 also include all electronics associated with the various sensors and equipment therein and necessary to communicate with communication system 120.

Carbon monoxide is generated when material temperature increases sufficiently to cause the material to smolder prior to flaming combustion. Consequently, by detecting unexpected increases in levels of carbon monoxide, carbon monoxide sensor 150 is particularly effective in the detection of very early stages of a fire when smoldering of heated material produces incomplete combustion. Furthermore, carbon monoxide is lighter than major components of typical ambient atmospheres and thus is readily transported to detector locations, typically at the ceiling of an enclosed space. In contrast, particulates and ionized combustion products are typically heavier than the ambient atmosphere and must be transported to such sensor locations by convection due to the heat produced by the fire.

Temperature sensor 154 and humidity sensor 156 are particularly useful in slightly later but still very early stages of a potential fire. Because humidity is essentially a solution of materials in gaseous phase, the solution tends to rapidly become homogeneous throughout an enclosed space. Thus, changes in humidity can be rapidly detected by humidity sensor 156 at any location within the space. As combustible material is heated, moisture therein is driven off, increasing humidity in an enclosed space roughly in proportion to the delivery of heat to the material and increase of the temperature thereof. In addition, relative humidity is a function of the ambient temperature. Therefore, humidity increasing while temperature remains constant or other humidity variation not accounted for by temperature changes are characteristic of very early stages of a potential fire and may actually precede detection of carbon monoxide. Next, as the potential fire begins to increase the temperature of the ambient atmosphere, moisture in the heated material is depleted and the relative humidity decreases rapidly. However, since moisture continues to be driven off as the region of heated material increases, the rapid decrease in relative humidity is usually somewhat less than can be accounted for by temperature alone. These known relationships between temperature and humidity are characteristic of early stage of a potential fire, before significant amounts of combustion products are formed. As a result, the fire detection and extinguishment system of the present invention can be made to respond to known temperature and humidity profiles characteristic of early stages of potential fire growth.

Infrared sensor 152 may include optical system 160 including lenses for producing a wide field of view and optical filters for limiting detection of common infrared sources such as incandescent bulbs. Alternatively, profile detector 136 may be programmed to ignore signals generated in known frequency regions of common electric lighting. Thus, as heat causes radiation from material to increase in the far and near infrared spectrum, early detection of potential fires can be accomplished at a stage just subsequent to the stages detectable by humidity detector 156 and within the ranges of potential fire progress also detectable by the combination of temperature and humidity sensors 154, 156. To provide coverage of early stages of a potential fire, in one preferred embodiment optical flicker frequency filter 162 provides optical frequency filtering of the output of infrared sensor 152 to provide flame detection when infrared signal level is only increasing slowly (e.g. before the fire is able to spread but where flames are present). During such early stages of fire growth combustion products are produced but the heat might yet be insufficient to produce convection sufficient to transport those combustion products to standard prior art smoke detector.

Thus, in a preferred embodiment, profile detector 136 of central control unit 130 compares input data measured over a period of time by carbon monoxide sensor 150, infrared sensor 152, temperature sensor 154 and humidity sensor 156 with data stored in memory which are known to be characteristic of early stages of a fire. When a match between collected data and stored data is detected, controlled fire extinguishment system 140 is activated. Additionally, the system should indicate whether measured ambient temperature has become high enough to become hazardous to personnel or to cause a spontaneous fire to occur.

Accordingly, the system of sensors 150, 152, 154 and 156 provides an array of overlapping capability for detecting different early stages of a potential fire well in advance of conditions detectable by prior art fire or smoke detectors. These different types of detection also provide a substantial degree of redundancy within fire detector unit 110.

It is also to be understood that the above types of sensors 150, 152, 154 and 156 would be preferably included within most fire detecting units of the system in accordance with the invention since these sensors detect conditions which are characteristic of a wide variety of early stage fires. However, the use of these types of sensors in the system of the invention should also be regarded as exemplary of many other types of chemical and physical condition sensors which are more specific to particular environments in which fires may occur and which may be chosen with particular knowledge of the local environment in which the particular fire detection and extinguishment system is operated. For example, sensors sensitive to particular combustion products, such as sulfur compounds could be used in areas proximate to wiring raceways to control a fire extinguishment system for that area only. Likewise, particular optical flicker frequency filtering and/or spectral filtering could be used to either detect or suppress detection of electrical arcing, depending on whether such a source of radiation was potentially indicative of a fire or normally present in the environment. Nitric oxide sensors, hydrogen sensors, oxygen sensors and pressure sensors are exemplary of other types of sensors which can be similarly used to increase the specificity of early fire detection in particular protected spaces in accordance with the invention.

It is desirable to provide an array of sensors which are highly specific to potential fires associated with particular environments in specific locations of the fire detection and extinguishment system in order to provide early fire detection and minimize both fire and collateral damage. By increasing the specificity of fire detection, it is also possible to discern conditions where an alarm only response of the system is appropriate, for example, in extremely early fire development stages where the atmosphere of a protected space is not compromised in regard to the presence of fire-fighting personnel but where insufficient heat has been developed for automatic fire extinguishment systems to be adequately effective.

It is also preferable that fire detector units 110 be easily integrated with existing prior art fire detection systems such that the overall system provide a means for detecting fires both in early stages of development in accordance with the present invention as well as in later stages in accordance with the prior art. For this purpose, fire detector units 110 preferably include a connector 164 for connection of a manual pull box 166 for manually reporting a fire, e.g., a standard plug or terminal. Further, as a "sidecar", the fire detecting unit may include a standard smoke detector 168. The annunciator of standard smoke detector can be used to provide a local alarm if desired. However, since the present invention detects the very early stage of the development of a potential fire, it is considered preferable to provide a separate annunciator 170 capable of producing an audible and/or visual warning which is distinct from that of the standard smoke detector's annunciator.

A preferred construction for fire detector unit 110 is shown in exploded form in FIG. 2. Fire detector unit 110 includes housing 200 suitable for having the various fire related condition sensors and any necessary circuit boards and electronics associated therewith mounted therein. Housing 200 should be capable of being mounted on a ceiling or other generally planar surface of an enclosed space. Housing 200 includes a plurality of openings 202 to allow access to the various fire related condition sensors mounted therein, e.g., to allow circulation of ambient gases to carbon monoxide sensor 150 and to allow optical access of the infrared sensor 152 to the exterior of the housing 200. If carbon monoxide sensor 150 is located on or above one or more circuit boards such as board 210, corresponding opening should be provided so that the board or boards do not significantly restrict the gas circulation. Such mounting is considered preferable since available carbon monoxide sensors and electronic circuits associated therewith are often mounted on a separate board which can be mounted and connected with other boards by means of plug 212 and socket 214.

Housing 200 also preferably contains an annunciator 170 such as a standard horn unit and may include additional boards, as necessary, such as board 220 which carries the electronics necessary for interfacing with communication system 120 (such as is schematically depicted at 158 of FIG. 1). For purposes of establishing an identity/address for the particular fire detecting unit, address switches 222 are preferably provided on board 220. Board 220 also preferably carries a plug 224 for connection to board 210 by means of socket 226, a connector 164 for connection to a manual pull box (166 of FIG. 1) and means 228 for mechanically mounting a standard underwriter approved smoke detector 168 and providing electrical connection thereto, preferably through the same structure. Board 210, or additional boards, can accommodate any necessary electronics or additional sensors.

Housing 200 is preferably assembled with boards 210 and 220 by inserting an insulator 230 between the boards and attaching the boards together by means of plug 224, socket 226 and possibly additional well known hardware, not shown. The board assembly is then preferably fitted over a raised stud 232 formed as part of the housing 200 or the standard smoke detector attached to board 220 and secured by fastener 234, preferably in the form of a spring-nut.

Figure 3:
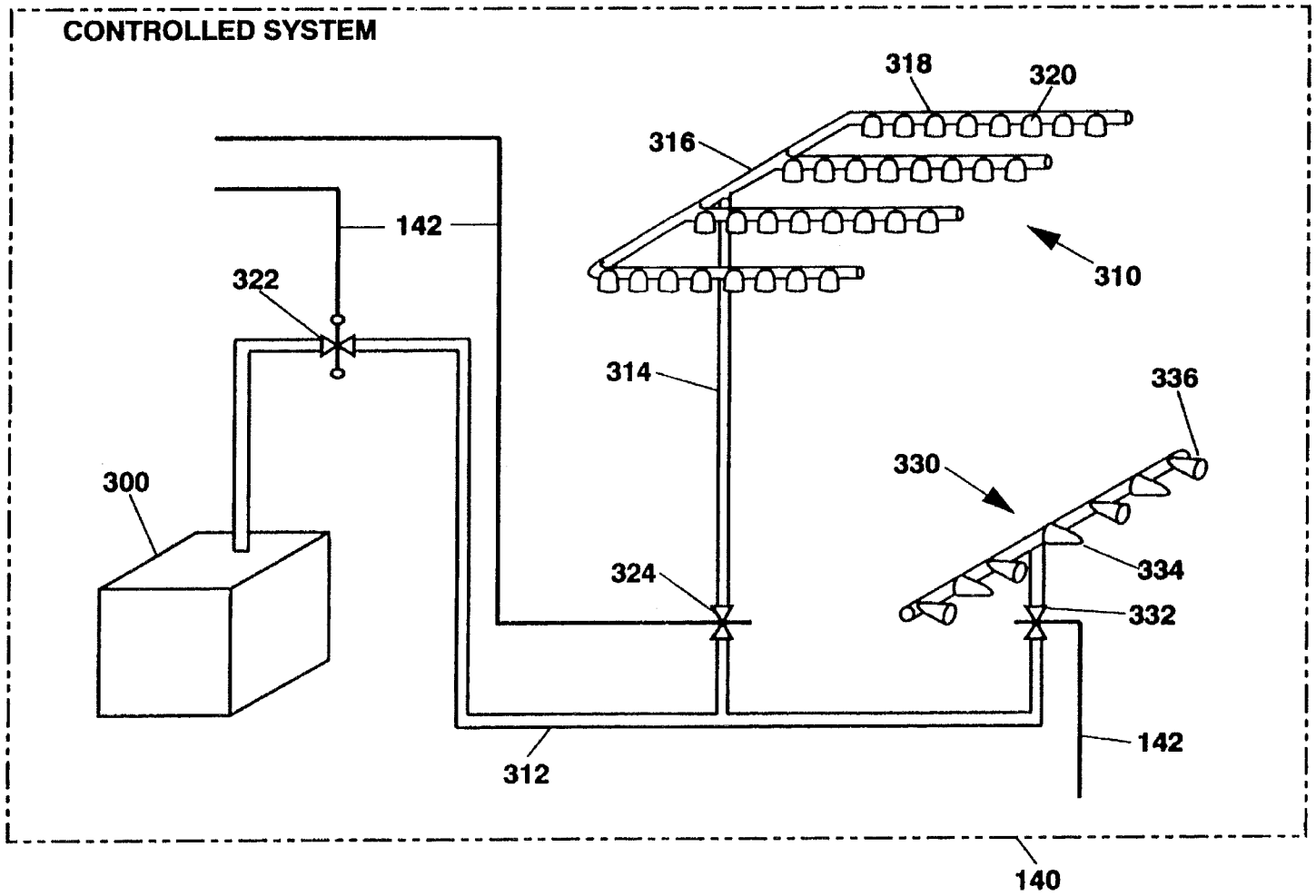
FIG. 3 is a schematic diagram of the fire extinguishment system in accordance with the invention and corresponding to the controlled system shown in FIG. 1.

Referring now to FIG. 3, the fire extinguishment system in accordance with the invention will now be described. Water tank 300 preferably is of a capacity of 10–100 gallons and capable of maintaining the water at a pressure of about 250 psi or greater. Water in tank 300 communicates with localized water mist supply and distribution system 310 through supply main 312. Supply main 312 is preferably kept drained except when a fire is detected in order to avoid corrosion, freezing or other deterioration which might cause rupturing of the pipes when high pressure water is introduced. A localized water mist supply and distribution system 310, comprising supply riser 314, distribution manifold 316, distribution branches 318 and water mist nozzles 320, can be associated with each fire detector unit 110, 110*a*, 110*b*, etc., of the present invention. Alternatively, multiple fire detector units can be associated with a single water mist supply and distribution system. The number of fire detector units and water mist supply and distribution systems used is not a limitation of the present invention.

In response to a detection of a fire or potential fire by fire detector unit 110 and profile detector 136, central control unit 130 sends a control signal over control lines 142 opening main activation valve 322 thus allowing water under pressure to be transported from tank 300 to the vicinity of the detected fire through supply main 312. Additional control signals are sent over control lines 142 opening appropriate supply system activation valves 324 thus providing water under pressure through supply riser 314 into distribution manifold 316 and distribution branches 318 corresponding to the area above where the potential fire is detected. Distribution branches 318 are fitted with a plurality of water mist nozzles 320. By directing a narrow, high pressure, water jet against a surface such as a deflection pin, water mist nozzles 320 develop a volume of fine mist water particles having diameters on the order of 100 microns. In order to control distribution of the water particles and adapt the fire extinguishment system to the shape of protected spaces, the geometry of the water jet may be altered by providing a suitable orifice shape, the surface against which the water jet is directed may be suitably shaped, or a combination of the two may be employed. Suitable types of such nozzles are available from Bete Fog Nozzle, Inc. under model designations PJ, OC, FF and NF. As used in the present invention, these nozzles are preferably provided with water at approximately 250 psi. Nozzles 320 are preferably spaced at approximately 16 inch intervals on distribution branches 318 that are spaced at approximately four foot intervals to provide a design water distribution density of 0.05 gallons per minute for each square foot of the protected area corresponding to a particular fire detector unit 110. System integrity is preferably enhanced by providing internal strainers within the nozzles and providing plastic blow-off caps for the nozzles.

The large surface area provided by these water particles and the high specific heat of water allows extremely rapid heat transfer from the potential fire to the mist particles. This absorption of heat can extinguish a potential fire ("smoldering" fire) or an actual fire in early stages of growth very quickly since the small amount of combustion, if any, cannot add sufficient heat to sustain the progress of the fire. Often, such potential fires can be extinguished in less than 15 seconds and with the application of only small amounts of water mist to the enclosed area and the contents thereof. The cooling effect of the water mist also effectively stabilize the heated materials at a reduced temperature for a period sufficient for corrective fire-fighting action to be taken.

The use of a water mist thus avoids the application of a large volume of water to an early stage fire or potential fire as in standard prior art fire extinguishing methods. Additionally, the present invention may include standard fire extinguishing system 330 as shown by valve 332 and wide and narrow fan nozzles 334 and 336. The standard fire extinguishing method could be used when a larger fire is detected by smoke detector 168 or for specific applications in various locations such as in halls or between equipment in the space containing the fire. Smoke detector 168 could send a signal through control line 142 directly to control valve 332 whose open or closed position status would be monitored by status line 144, as shown in FIG. 1. Status line 144 is preferably also used to monitor the open or closed position of other valves so that operation of the fire extinguishment system may be made redundant and operable in stages. This has the beneficial effect of increasing system reliability while minimizing collateral damage consistent with fire extinguishment. The invention thus provides for the use of a minimum amount of water which will remain in atmospheric suspension until it can be vented after the fire is extinguished. The water mist also has the advantages of being non-toxic to personnel and need not be vented before fire-fighting personnel can take further corrective action in regard to the source of the potential fire.

The present fine water mist extinguishment system employs only small amounts of water, consequently, damage is minimal and unlikely to affect operation of even sensitive electronic equipment. In this regard, it has been found that the fine water mist also avoids damage by assisting in removal of smoke and other electrically conductive particulates from the atmosphere. The small amount of water used during a short interval of operation does not deplete the contents of tank 300, leaving the system capable of responding to other fires or potential fires. Further, the contents of tank 300 can be continuously replenished without requiring shutting down of the system.

The present invention has numerous advantages. A fire detection and extinguishment system has been provided which rapidly detects and extinguishes fires in their very early stages (typically at the very first stages of their growth phase even before smoke or flames are generated, although the system is useful as well for detecting and extinguishing intermediate and large fires). Smoldering fires are extinguished using a water mist system with minimal damage to objects or enclosed spaces in the vicinity of the fire. The selectivity provided in fire detection avoids the need to reduce sensor sensitivity in order to avoid false alarms. The invention thus provides a much higher degree of protection than has been previously available. Extinguishment of fires is especially rapid since the use of non-toxic water mist does not require the evacuation of personnel before actuation of the extinguishment system.

While the invention is clearly advantageous in the more critical application of shipboard fires, it is equally applicable and provides identical advantages in other applications such as dwelling houses and offices. The invention is particularly advantageous in applications involving electronic equipment since it avoids the application of a large volume of water to electronic equipment.

While the invention has been described in terms of a preferred embodiment, those skilled in the art will recognize that the invention can be practiced with modification within the spirit and scope of the appended claims.

What is claimed is:

1. A fire detection and extinguishment system for detecting and extinguishing early stage fires in a protected space, comprising:

at least one fire detector unit including at least a carbon monoxide sensor and a radiation sensitive flame detector, said at least one fire detector unit associated with a localized portion of a protected space;

a central control unit including at least a sampler for periodically receiving data measured by at least said carbon monoxide sensor and said radiation sensitive flame detector, a memory for storing said received data and a profile detector responsive to said stored data, said memory storing therein said received data in the form of time profiles of variations of said data measured over a period of time by at least said carbon monoxide sensor and said radiation sensitive flame detector, said memory further having stored therein known data indicative of early stages of a fire, said known data corresponding to said data measured by at least said carbon monoxide sensor and said radiation sensitive flame detector, wherein said profile detector compares said measured data with said corresponding known data;

a communication system for communicating between said at least one fire detector unit and said central control unit; and a controlled fire extinguishment system responsive to said central control unit, wherein said controlled fire extinguishment system includes at least one localized fine water mist supply and distribution system functioning to absorb heat produced by early stage fires, a central water supply for supplying pressurized water, at least one water supply main for transporting said pressurized water from said central water supply to said at least one localized fine water mist supply and distribution system, and at least one valve responsive to said central control unit for activating a flow of said pressurized water to said at least one localized fine water mist supply and distribution system, wherein said flow of pressurized water is supplied at a pressure of approximately 250 psi, said at least one localized fine water mist supply and distribution system responsive to one or more of said at least one fire detector unit and positioned within a localized portion of a protected space associated with said one or more of said at least one fire detector unit, and further said at least one localized fine water mist supply and distribution system including a plurality of distribution branches, a plurality of water mist nozzles mounted on each of said distribution branches, a supply riser and a distribution manifold for providing said pressurized water to said plurality of distribution branches, said nozzles being spaced at approximately 16 inch intervals on said distribution branches, said distribution branches being spaced at approximately four foot intervals along said distribution manifold, wherein said at least one fine water mist supply and distribution system provides a controlled distribution of fine water mist comprising water particles having diameters of about 100 microns at a water distribution density of about 0.05 gallons per minute for each square foot of protected area within said localized portion of a protected space associated with said at least one fire detector unit, wherein upon said profile detector detecting a correlation between said measured data and said corresponding known data said central control unit activates said localized fine water mist supply and distribution system for providing said controlled distribution of fine water mist, said controlled distribution of fine water mist providing a large surface area of water particles for transferring heat out of early stage fires such that fire progression is halted.

2. A system as recited in claim 1, wherein said at least one fire detector unit further includes a humidity sensor, said sampler periodically receives data measured by said humidity sensor, said memory stores said received data in the form of a time profile of variations of said data measured over a period of time by said humidity sensor, and said profile detector is further responsive to said stored data measured by said humidity sensor.

3. A system as recited in claim 1, wherein said at least one fire detector unit further includes a temperature sensor, said sampler periodically receives data measured by said temperature sensor, said memory stores said received data in the form of a time profile of variations of said data measured over a period of time by said temperature sensor, and said profile detector is further responsive to said stored data measured by said temperature sensor.

4. A system as recited in claim 2, wherein said at least one fire detector unit further includes a temperature sensor, said sampler periodically receives data measured by said temperature sensor, said memory stores said received data in the form of a time profile of variations of said data measured over a period of time by said temperature sensor, and said profile detector is further responsive to said stored data measured by said temperature sensor.

5. A system as recited in claim 1, wherein said radiation sensitive flame detector comprises an infrared sensor.

6. A system as recited in claim 4, wherein said known data stored in said memory further corresponds to said data measured by said temperature sensor and said humidity sensor.

7. A system as recited in claim 5, wherein said infrared radiation sensor includes spectral filtering means.

8. A system as recited in claim 7, wherein said infrared radiation sensor includes flame flicker frequency filtering means.

9. A system as recited in claim 6, further including a sensor sensitive to combustion products produced by specified combustible material located within the protected space.

* * * * *